US007048646B2

(12) United States Patent
Yamanaka et al.

(10) Patent No.: US 7,048,646 B2
(45) Date of Patent: May 23, 2006

(54) PUTTER HEAD

(75) Inventors: Yasuyo Yamanaka, Saitama (JP); Makoto Kubota, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 3 days.

(21) Appl. No.: 10/851,673

(22) Filed: May 24, 2004

(65) Prior Publication Data

US 2005/0049078 A1 Mar. 3, 2005

(30) Foreign Application Priority Data

Aug. 25, 2003 (TW) ..... 092305182 U
Sep. 25, 2003 (JP) ..... P2003-333729

(51) Int. Cl.
*A63B 53/04* (2006.01)

(52) U.S. Cl. ..... 473/332; 473/349; 473/340; 473/341

(58) Field of Classification Search ..... 473/324, 473/349, 340, 341, 332, 334–339
See application file for complete search history.

(56) References Cited

U.S. PATENT DOCUMENTS 5,820,481 A * 10/1998 Raudman ..... 473/313
6,095,931 A * 8/2000 Hettinger et al. ..... 473/341
2002/0098911 A1* 7/2002 Nelson et al. ..... 473/340

FOREIGN PATENT DOCUMENTS

JP 2001-190721 A 7/2001

* cited by examiner

*Primary Examiner*—Sebastiano Passaniti
(74) *Attorney, Agent, or Firm*—Sughrue Mion, PLLC

(57) ABSTRACT

A putter head includes a first half member, a second half member, and an insert. The first half body includes a first metal, and has a face surface on a front face. The second half body includes a second metal, which is higher in specific gravity than the first metal, and is attached to the forward half body. The insert is disposed inside the first half body to be along the face surface and includes one selected from a group consisting of a synthetic resin and a rubber.

6 Claims, 4 Drawing Sheets

PUTTER HEAD

BACKGROUND OF THE INVENTION

1. Field of the Invention

The present invention relates to a putter head, and particularly to a putter head which is superior in absorbability of shock produced when hitting a ball.

2. Description of the Related Art

For the purpose of absorbing shock occurring when a putter head hits a ball and improving feeling of hitting, JP-A-2001-190721 discloses that a putter head includes a resin material such as urethane resin on a face surface thereof.

SUMMARY OF THE INVENTION

Since the resin material is exposed to the face surface in the putter head disclosed in JP-A-2001-190721, the resin material is damaged easily and has less durability.

The invention provides a putter head, which is superior in absorbability of shock occurring when hitting a ball and has good durability.

According to one embodiment of the invention, a putter head includes a first half body, a second half body, and an insert. The first half body includes a first metal, and has a face surface on a front face. The second half body includes a second metal, which is higher in specific gravity than the first metal, and is attached to the forward half body. The insert is disposed inside the first half body to be along the face surface and includes one selected from a group consisting of a synthetic resin and a rubber.

In the putter head, the insert, which disposed inside the first half body and includes one selected from the group consisting of the resin and the rubber, absorbs the shock occurring when hitting the ball.

Since, the insert is disposed along the face surface, the insert can absorb the shock easily.

The following configuration is preferable. The first half body defines a recess on a rear face thereof. The insert is disposed in the recess. The second half body presses the insert. With this configuration, since the insert is pressed against the first half body and closely contacted therewith, the shock produced in the first half body is securely transmitted to the insert, and sufficiently absorbed.

The following configuration may be adopted. The first half body extends in a toe-heel direction of the putter head. The second half body includes a first member and a second member. The first member continues from a toe side of the first half body to a heel side of the first half body and bulges toward rearward of the first half body. The second member protrudes from a center of the first half body in the toe-heel direction. One end of the second member continues to the first member. The first member and the second member are integrated with each other. A lid member is disposed at the other end of the second member and has a dimension so that the lid member is fitted to the recess. The first half body and the second half body are connected with each other so that the lid member presses the insert. With this configuration, the putter head has a large moment of inertia around the center of gravity, so that the sweet area of the putter head is wide. Also, the insert is sufficiently pressed against the first half body by the lid member.

In this case, the following configuration is preferable. The recess includes an entrance portion, an innermost portion, and a step portion. The entrance portion retreats from the rear face of the first half body. The innermost portion is formed behind the entrance portion and has smaller space than the entrance portion. The step surface is formed between the entrance portion and the innermost portion and is in parallel to the face surface. The insert is disposed in the innermost portion. The lid member is in contact with the step surface. Since the lid body is disposed in the innermost portion and contact with the step surface to press the insert, the insert is pressed and contracted at a predetermined ratio. Thereby, the shock absorption characteristic is securely achieved as designed.

DETAILED DESCRIPTION OF THE PREFERRED EMBODIMENTS

Figure 1:
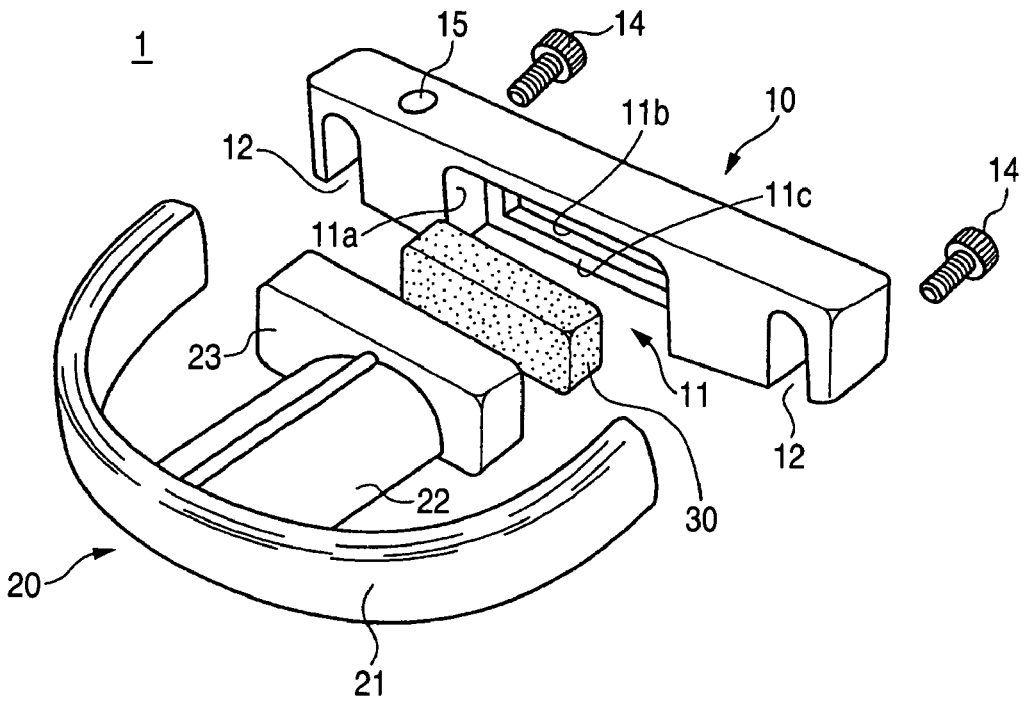
FIG. 1 is an exploded perspective view of a putter head according to an embodiment of the invention.
Figure 2:
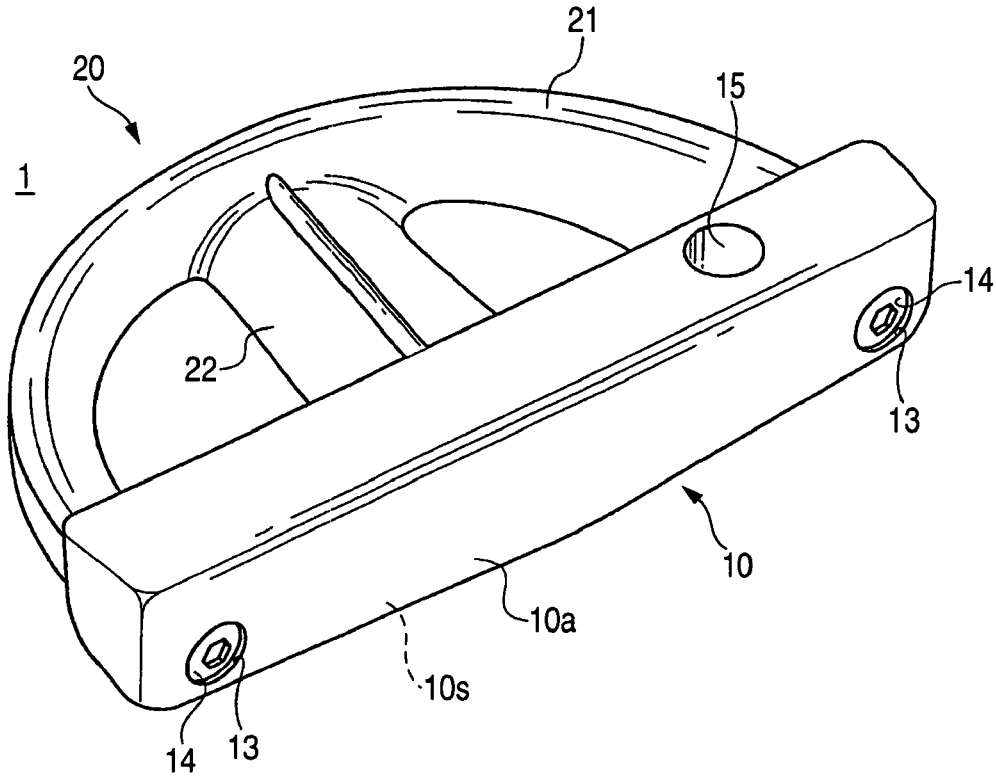
FIG. 2 is a perspective view of the putter head of FIG. 1.
Figure 3:
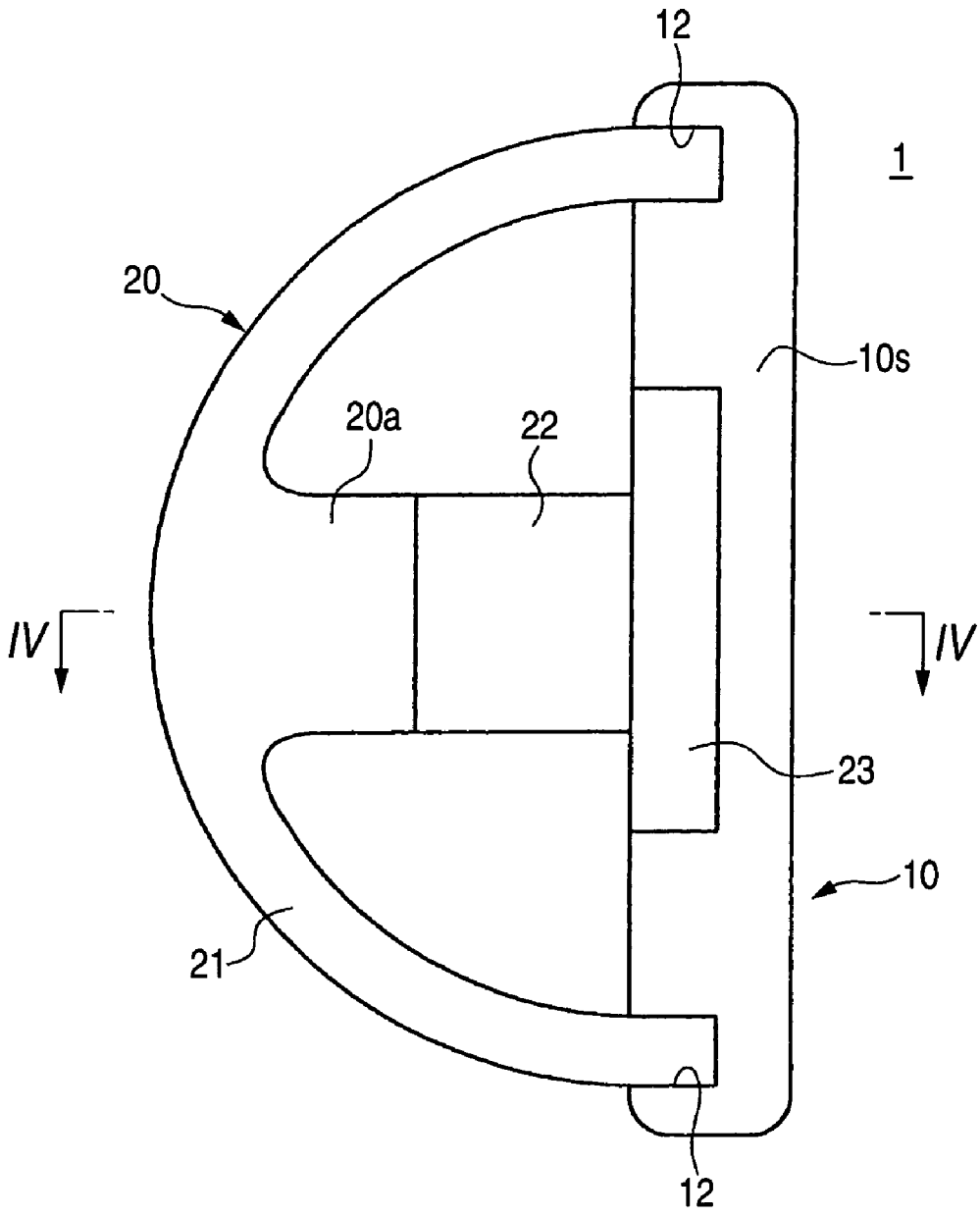
FIG. 3 is a bottom view of the putter head of FIG. 1.
Figure 4:
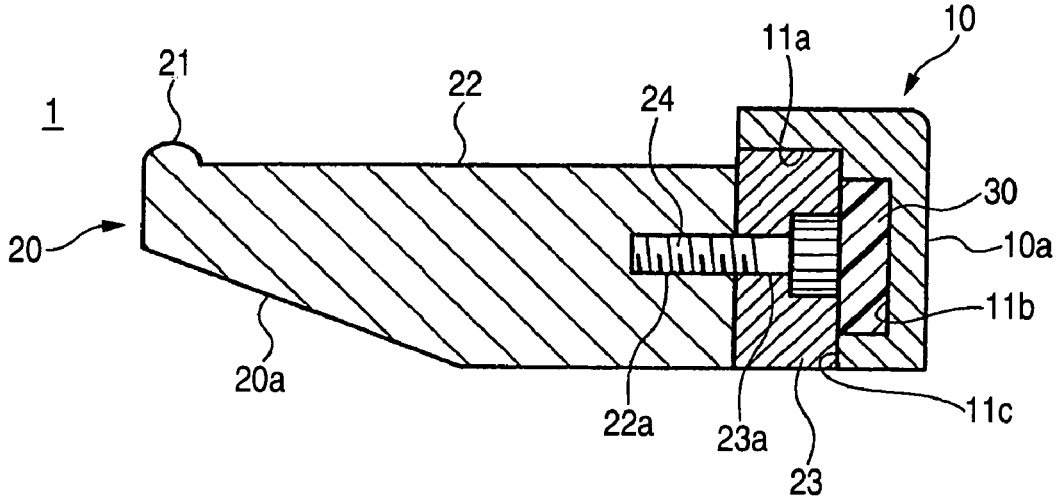
FIG. 4 is a cross-sectional view taken along line IV—IV in FIG. 3.

Referring to FIGS. 1 to 4, embodiments of the invention will be described below in detail. FIG. 1 is an exploded perspective view of a putter head according to an embodiment of the present invention. FIG. 2 is a perspective view of the putter head. FIG. 3 is a bottom view of the putter head. FIG. 4 is a cross-sectional view taken along line IV—IV in FIG. 3.

The putter head includes a forward half body 10 made of a low specific gravity metal material, a backward half body 20 made of a high specific gravity metal material, and an insert 30 made of rubber or a synthetic resin. The insert have hardness in a range of 20 (JISC) to 90 (JISC), preferably in a range of 30 (JISC) to 80 (JISC).

The forward half body 10 has a shape of almost rectangular parallelepiped extending in a toe-heel direction connecting a toe (left end in FIG. 2) and a heel (right end in FIG. 2). A sole face 10*s* of the forward half body 10 has a circular arc shape in which a central part in the toe-heel direction slightly bulges toward the lower side. A front face of the front half body 10 is a face surface 10*a* for hitting a ball.

On the back face of the forward half body 10, a recess 11 is formed in the neighbor of a middle part in the toe-heel direction. This recess 11 includes an entrance portion 11*a*, an innermost portion 11*b*, and a step surface 11*c*. The innermost portion 11*b* is concave from the innermost side of the entrance portion 11*a* (the side of the face surface 10*a*) toward the face surface 10*a*. The step surface 11*c* is formed in a boundary between the entrance portion 11*a* and the innermost portion 11*b*. The entrance portion 11*a* is a notch extending in the toe-heel direction and opening to the back face and the bottom face of the forward half body 10. The innermost portion 11*b* is a groove being concave from the face surface 10*a* side of the entrance portion 11*a*. The innermost portion 11*b* extends in the toe-heel direction. The innermost portion 11*b* is slightly smaller than the entrance portion 11*a*. The step surface 11*c* resides all around the innermost portion 11*b*.

Notch portions 12 are formed on both ends of the forward half body 10 in the toe-heel direction on the back surface thereof. The notch portions open to the sole face 10*s*. Insertion holes 13 for bolts 14 are formed to communicate the face surface 10*a* side of the notch portion 12 with the face surface 10*a*. Each insertion hole 13 has a large diameter portion on the face surface 10*a* side and a small diameter portion on the back face side, as with an insertion hole 23*a* described later. A head portion of the bolt 14 is disposed in the large diameter portion of the insertion hole 13.

A shaft insertion hole 15 is formed in an upper face of the forward half body 10 on the heel side.

The backward half body 20 includes an outer circumferential bar-like body 21 having a semi-circular arc shape, a central bar-like body 22 integrated with a central part of the outer circumferential bar-like body 21 in an extending direction, and a lid body 23 attached to a top end face of the central bar-like body 22 by a bolt 24. A rear bottom face of the central bar-like body 22 constitutes a slant face 20*a* (FIG. 4) with a gradient rising toward the aftermost end of the backward half body 20.

Both end portions of the outer circumferential bar-like body 21 have a shape and dimension so that the both ends can be fitted into the notch portions 12. Female screw holes (not shown) coaxial with the insertion hole 13 are formed on surfaces of the both ends of the outer circumferential bar-like body 21, respectively. The both ends of the outer circumferential bar-like body 21 is fitted to the notch portions 12 and the bolts 14 are screwed into the screw holes, thereby the forward half body 10 and the backward half body 20 are connected.

The lid body 23 has dimension so that the lid body 23 can be fitted to the entrance portion 11*a*. As shown in FIG. 4, the lid body 23 is fixed to the central bar-like body 22 by screwing a bolt 24 into the female screw hole 22*a* provided at the top end face of the central bar-like body 22 through the insertion hole 23*a* provided in the lid body 23.

The insert 30 has longitudinal and transverse dimensions almost equivalent to the innermost portion 11*b*, and has a thickness (dimension in forward and backward direction of the head) slightly larger than the depth of the innermost portion 11*b* (e.g., by about 0.5 mm to 2 mm).

In assembling the putter head, after the insert 30 is inserted into the innermost portion 11*b*, the backward half body 20 with the lid body 23 is assembled with the forward half body 10, and then the bolts 14 are screwed. Thereby, both end faces 21*a* of the outer circumferential bar-like body 21 are contacted with the innermost faces of the notch portions 12, and the lid body 23 is contacted with the step surface 11*c* while pressing the insert 30. The insert 30 is closely contacted with all the inner periphery of the innermost portion 11*b* and the entire face of the lid body 23.

When a shaft is attached to the putter head 1, a putter is finished.

Since the insert 30 absorbs shock occurring when the putter hits a ball, the feeling of hitting is softened. The insert 30 is closely contacted with the forward half body 10 and the lid body 23 without gap. Also, a distance between the insert 30 and the face surface 10 is short (preferably, in a range of from 1 mm to 5 mm, more preferably, from 2 mm to 4 mm). Therefore, the shock is sufficiently absorbed.

In this embodiment, since the backward half body 20 having high specific gravity is formed in a circular arc, the sweet area of the putter head is wide, and less shock occurs when a golfer hits a ball out of the sweet spot.

Preferably, the forward half body 10 is made of aluminum, magnesium, titanium, or their alloy, with the specific gravity of from 2 to 5. It should be noted that the invention is not limited thereto.

Preferably, the backward half body 20 is made of stainless, copper alloy, tungsten alloy (e.g., W—Cu alloy, W—Ni alloy), with the specific gravity of 7 to 14.

What is claimed is:

1. A putter head comprising:

a first half body including a first metal, and having a face surface on a front face;

a second half body including a second metal, which is higher in specific gravity than the first metal, and attached to the forward half body; and an insert, which is disposed inside the first half body to be along the face surface and includes one selected from a group consisting of a synthetic resin and a rubber, wherein the first half body defines a recess on a rear face thereof, the insert is disposed in the recess and the second half body presses the insert;

wherein the first half body extends in a toe-heel direction of the putter head;

wherein the second half body includes a first member, having substantially a semi-circular arc shape, continuing from a toe side of the first half body to a heel side of the first half body and disposed on a rearward portion of the first half body and a second member protruding from a center of the rearward portion of the first half body in the toe-heel direction;

wherein one end of the second member continues to the first member, the first member and the second member are integrated with each other;

wherein a lid member is disposed at the other end of the second member and has a dimension so that the lid member is fitted to the recess; and wherein the first half body and the second half body are connected with each other so that the lid member presses the insert.

2. The putter head according to claim 1, wherein:

the first half body has specific gravity in a range of from 2 to 5; and the second half body has specific gravity in a range from 7 to 15.

3. The putter head according to claim 1, wherein the insert includes thermoplastic elastomer.

4. A putter head comprising:

a first half body including a first metal, and having a face surface on a front face;

a second half body including a second metal, which is higher in specific gravity than the first metal, and attached to the forward half body; and an insert, which is disposed inside the first half body to be along the face surface and includes one selected from a group consisting of a synthetic resin and a rubber, wherein the first half body defines a recess on a rear face thereof, the insert is disposed in the recess and the second half body presses the insert;

wherein the first half body extends in a toe-heel direction of the putter head;

wherein the second half body includes a first member continuing from a toe side of the first half body to a heel side of the first half body and disposed on a rearward portion of the first half body; and a second member protruding from a center of the rearward portion of the first half body in the toe-heel direction;

wherein one end of the second member continues to the first member, the first member and the second member are integrated with each other;

wherein a lid member is disposed at the other end of the second member and has a dimension so that the lid member is fitted to the recess;

wherein the first half body and the second half body are connected with each other so that the lid member presses the insert;

wherein the recess includes an entrance portion, which retreats from the rear face of the first half body; an innermost portion, which is formed behind the entrance portion and has smaller space than the entrance portion; and a step surface, which is formed between the entrance portion and the innermost portion and is in parallel to the face surface;

wherein the insert is disposed in the innermost portion; and wherein the lid member is in contact with the step surface.

5. The putter head according to claim 4, wherein:

the first half body has specific gravity in a range of from 2 to 5 ; and the second half body has specific gravity in a range from 7 to 15.

6. The putter head according to claim 4, wherein the insert includes thermoplastic elastomer.

* * * * *

UNITED STATES PATENT AND TRADEMARK OFFICE

CERTIFICATE OF CORRECTION

PATENT NO. : 7,048,646 B2
APPLICATION NO. : 10/851673
DATED : May 23, 2006
INVENTOR(S) : Yasuyo Yamanaka and Makoto Kubota It is certified that error appears in the above-identified patent and that said Letters Patent is hereby corrected as shown below:

In claim 1, column 4, line 7, please delete “forward” and insert --first--

In claim 4, column 4, line 44, please delete “forward” and insert --first--

Signed and Sealed this

Twenty-eighth Day of November, 2006

JON W. DUDAS
*Director of the United States Patent and Trademark Office*